US006840189B2

(12) United States Patent
McNally

(10) Patent No.: US 6,840,189 B2
(45) Date of Patent: Jan. 11, 2005

(54) METHOD AND APPARATUS FOR ENABLING WORK TO BE CARRIED OUT ON A SUBMERGED PORTION OF A VESSEL

(76) Inventor: Frederick Joseph McNally, 57 Elm Avenue, Upton, Wirral, CH49 4NP (GB)

( * ) Notice: Subject to any disclaimer, the term of this patent is extended or adjusted under 35 U.S.C. 154(b) by 0 days.

(21) Appl. No.: 10/393,821

(22) Filed: Mar. 20, 2003

(65) Prior Publication Data

US 2004/0182302 A1 Sep. 23, 2004

(51) Int. Cl.[7] ..... B63G 8/00

(52) U.S. Cl. ..... 114/312; 114/322; 114/323; 405/8; 405/12; 405/14

(58) Field of Search ..... 114/312, 322, 114/323, 342; 405/8–14

(56) References Cited

U.S. PATENT DOCUMENTS 1,963,996 A * 6/1934 Simon ..... 405/192
3,466,880 A * 9/1969 Elliott ..... 405/190
3,572,041 A * 3/1971 Graaf ..... 405/205
3,611,968 A 10/1971 Takezawa
4,615,641 A 10/1986 Novay
4,991,996 A 2/1991 Tate
5,324,140 A * 6/1994 Lopez et al. ..... 405/188

FOREIGN PATENT DOCUMENTS

GB 2 114 636 A 8/1983
GB 2 220 019 A 12/1989
GB 2 371 269 B 3/2003

* cited by examiner

*Primary Examiner*—Sherman Basinger
(74) *Attorney, Agent, or Firm*—Blakely, Sokoloff, Taylor & Zafman; Stephen M. De Klerk

(57) ABSTRACT

The apparatus comprises a generally cylindrical or sleeve-like or tubular housing 2 having an opening at one end which is locatable to be in sealing engagement with the outer surface of part of the hull 3 of a submarine with said housing 2 forming a water evacuable space around the propulsor unit 1 of the submarine, and access passages or ducts 4,5 for work personnel in communication with said space and extending upwardly from said housing 2 such as to, in use, to be above the surface of the water in which the submarine is floating.

19 Claims, 8 Drawing Sheets

METHOD AND APPARATUS FOR ENABLING WORK TO BE CARRIED OUT ON A SUBMERGED PORTION OF A VESSEL

The present invention concerns a method and apparatus for enabling work to be carried out on a submerged portion of a floating vessel, in particular on the propulsor unit of a nuclear submarine.

Currently, when work is required to be carried out on the propulsor unit of a nuclear submarine, for example if the vanes of the propulsor unit require repair or replacement involving welding operations or operations involving the exposure of bearing assemblies, the entire submarine must be removed from the water in a dry dock facility or on a lifting apparatus. This is an expensive and time consuming operation and requires specialist facilities that are of limited availability. It also requires the removal of any weapons from the submarine and results in the submarine being out of service for a considerable period of time. Furthermore, cooling of the nuclear reactor becomes a problem when the submarine is out of the water.

The method and apparatus of the present invention allow maintenance of the propulsor unit to be carried out without removing the submarine from the water by providing, while the propulsor unit is beneath the surface of the water, an air filled habitat around the propulsor unit in which work can be carried out.

According to a first aspect of the present invention there is provided an apparatus for providing an air space around a submerged portion of a floating submarine comprising a generally cylindrical or sleeve-like or tubular housing having an opening at at least one end which is locatable to be in sealing engagement with the outer surface of part of the hull of the submarine with said housing forming a water evacuable space around said part of the hull and any part or apparatus to be worked upon, and an access passage or duct for work personnel in communication with said space and extending upwardly from said housing such as to be, in use, above the surface of the water in which the submarine is floating. Preferably the horizontal cross-sectional area of the at least one access duct is substantially less than the horizontal cross sectional area of the housing.

When used on a nuclear submarine, the housing of the invention will, in use, normally be underwater. The horizontal cross-sectional area of the at least one access duct will normally be less than the horizontal cross sectional area of the housing so as to minimize the lift effect. Additional weights or ballast may be attached to the apparatus and particularly to a surrounding framework to counteract the lift effect when the water is removed from the housing.

Advantageously at least one access duct is provided adjacent each end of the housing, providing a through flow of air for ventilating the housing. Such an arrangement facilitates the removal of noxious gases which might be produced during, for example, welding operations.

Where difficulty would be experienced in locating part of the housing around the hull of a submarine, for example because of the projection of the rudder and hydroplanes adjacent the propulsor unit of the submarine, the housing may be formed in sections normally separable/connectable along transverse or upwardly extending planes and one section, normally the section which is closest to the bow, is itself formed in interconnectable sections, preferably four, separable/connectable along generally radial planes. The sections will normally be bolted together in sealing relationship, sealing means normally being provided between the separating surfaces.

The radially separable section of the housing will normally extend in the region where the rudder and the hydroplanes sections proximate the hull of the vessel and to facilitate fitting and/or provide safety clearance and to provide fitting or assembly tolerances for accommodating for any difficulties in bolting the quadrant segments together, the radially separable segments of the separable section of the housing will have spaced/non-abutting portions forming gaps which each provide a free space (normally four) adjacent the base of the rudder and the hydroplane sections, which gaps will normally be closed by thin and resilient sealing means secured to extend across the gaps i.e. securement to seal such.

While in the following description of a preferred embodiment of the invention the sleeve-like housing is formed from a rigid or substantially rigid material, such as sheet steel, it is envisaged that at least a portion of the sleeve-like housing might be formed from a flexible material. Such a flexible material might form a substantially annular central section of the housing sealingly interconnecting rigid forward and aft sections, or alternatively, the entire aft section of the housing might be constructed from a flexible material sealingly connected to a rigid forward section. It is also envisaged that the entire sleeve-like housing might be formed from a flexible material.

In a preferred embodiment the housing is formed in interconnectable sections, preferably two, connectable together along upwardly extending and normally vertical separation planes. At least one of said interconnectable sections will itself be formed in interconnectable segments having radial separating surfaces, which segments are locatable around the hull to form said part of the housing. Gaps closeable by resilient sealing means are provided between segments to facilitate bolting together of the sections if inaccuracies exist. A framework forming a walkway is mounted on the housing and leads to said access duct and preferably also provides ballast supporting platforms According to a further aspect of the invention a method of carrying out work on a submerged portion of a floating submarine comprises locating a generally cylindrical or sleeve like housing around a part of the hull of the submarine, said housing having at least one access duct extending upwardly from the housing to a position above the surface of the water, sealing one end of the housing against said part of the submarine, removing water from said housing to provide a gaseous and substantially water-free habitat in the region of said portion, and subsequently carrying out said work on said portion in the gaseous habitat, access to the housing being provided by means of the at least one access duct. Preferably the method also includes the step of providing ballast on the housing to counterbalance the buoyancy of the housing when the water is removed from said housing so that the housing has neutral buoyancy.

It is envisaged the interior of the housing, in use against a submarine hull, will be at atmospheric pressure.

The present invention will now be described further, by way of example, with reference to the accompanying drawings, in which.

Figure 1:
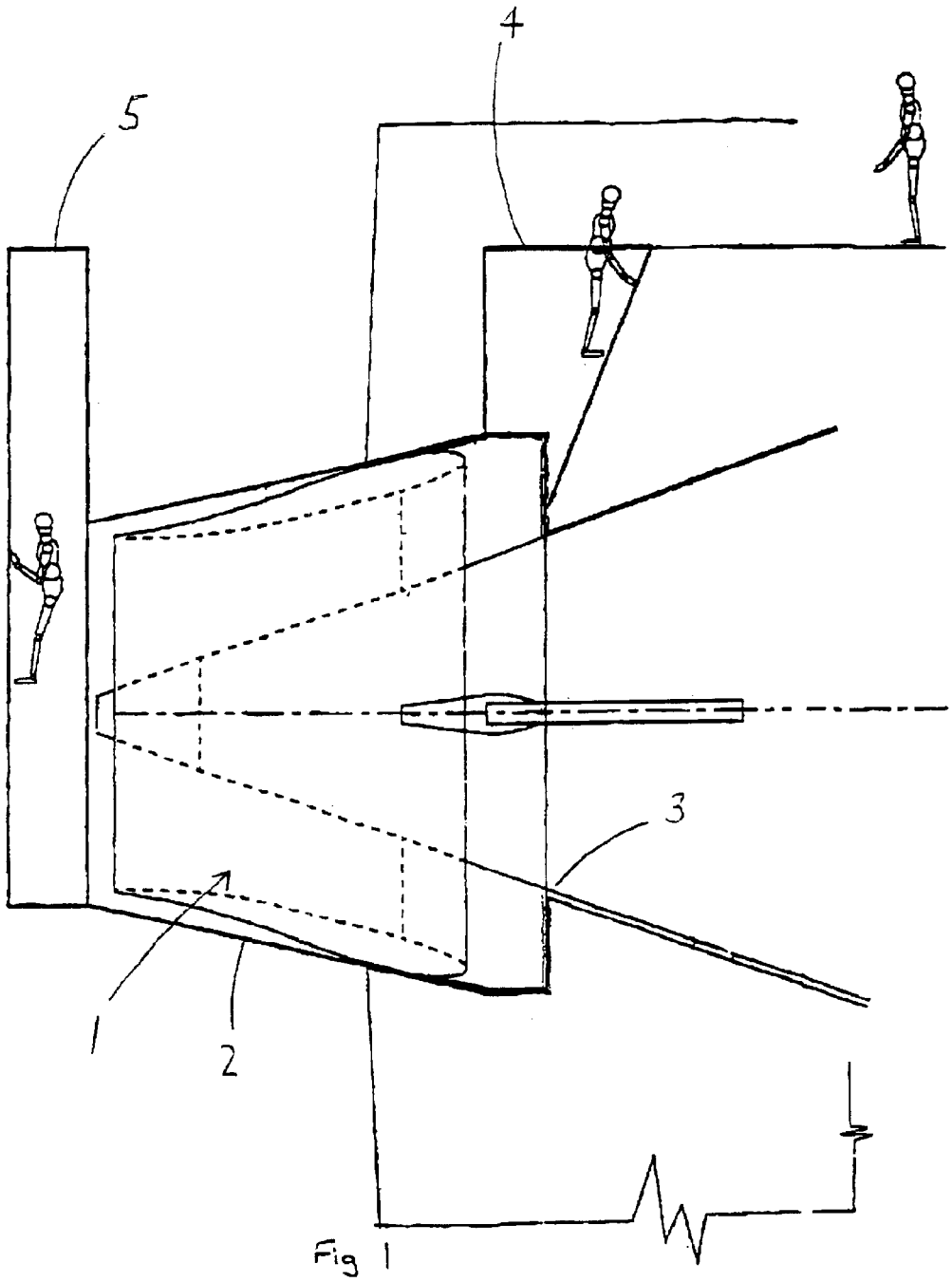
FIG. 1 is a schematic side elevation of an apparatus according to the invention fitted over the propulsor unit of a submarine.
Figure 2:
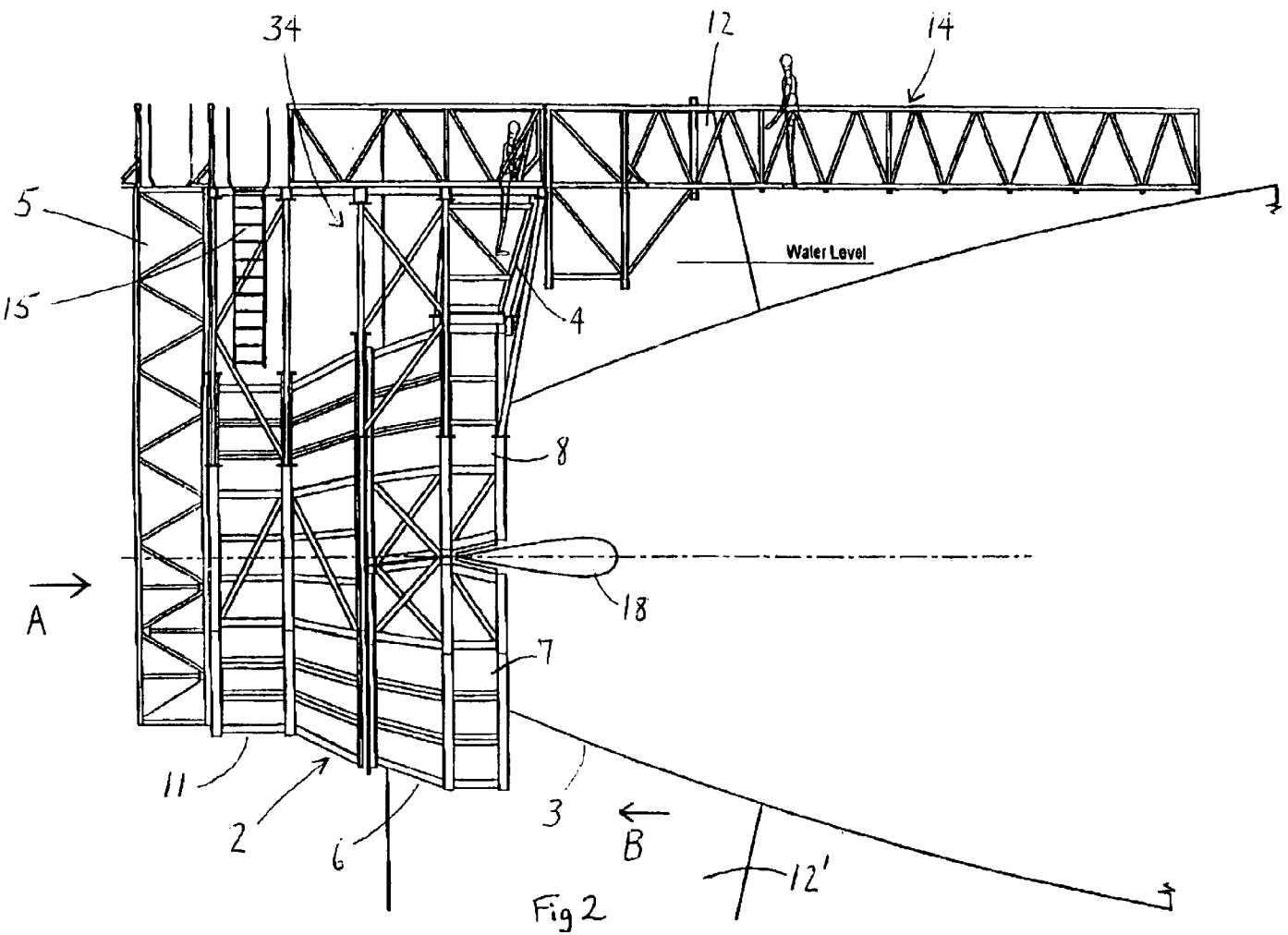
FIG. 2 is a side elevation of an embodiment of the invention fitted over the propulsor unit of a submarine.
Figure 3:
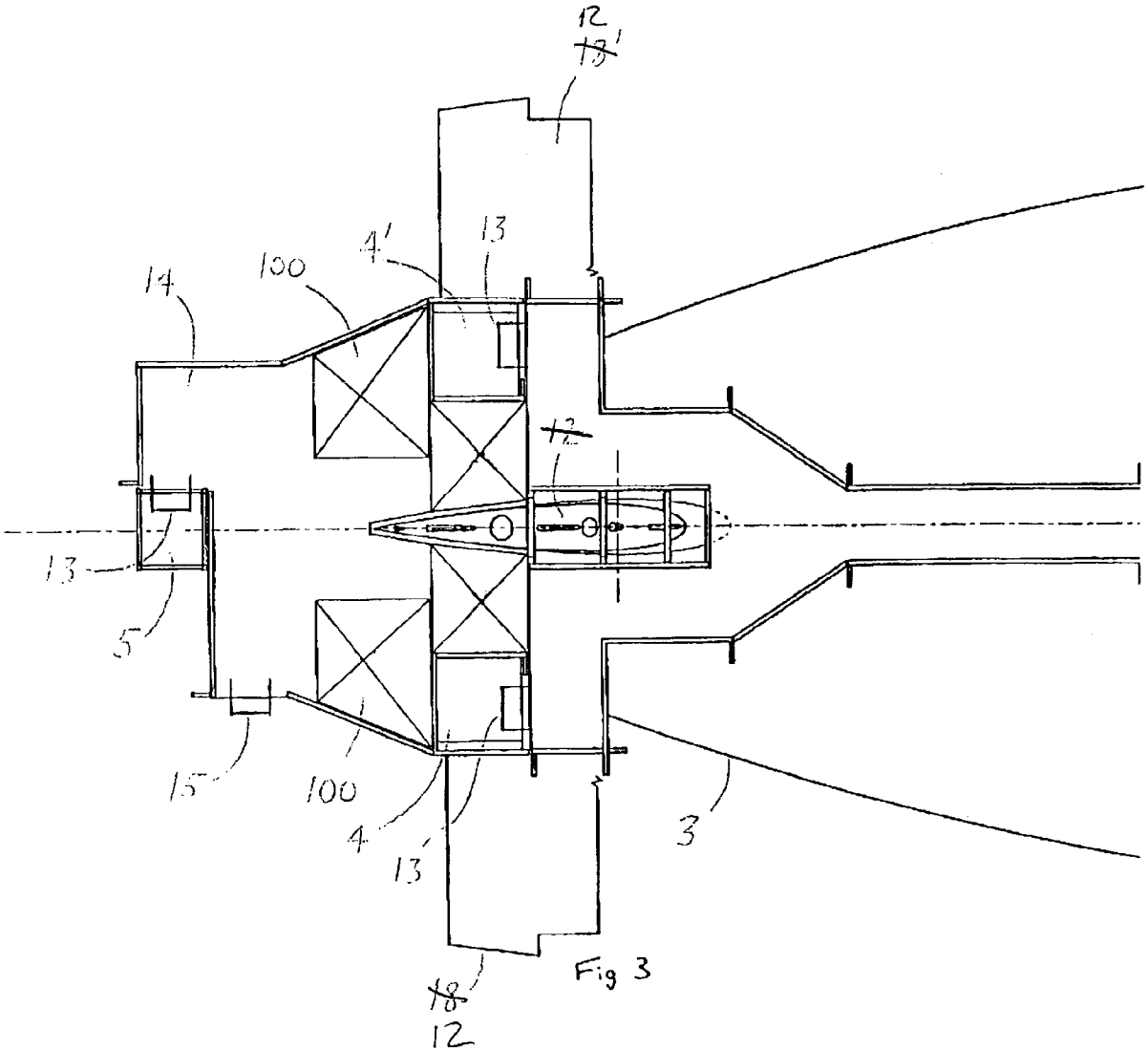
FIG. 3 is a plan view of the apparatus of FIG. 2.
Figure 4:
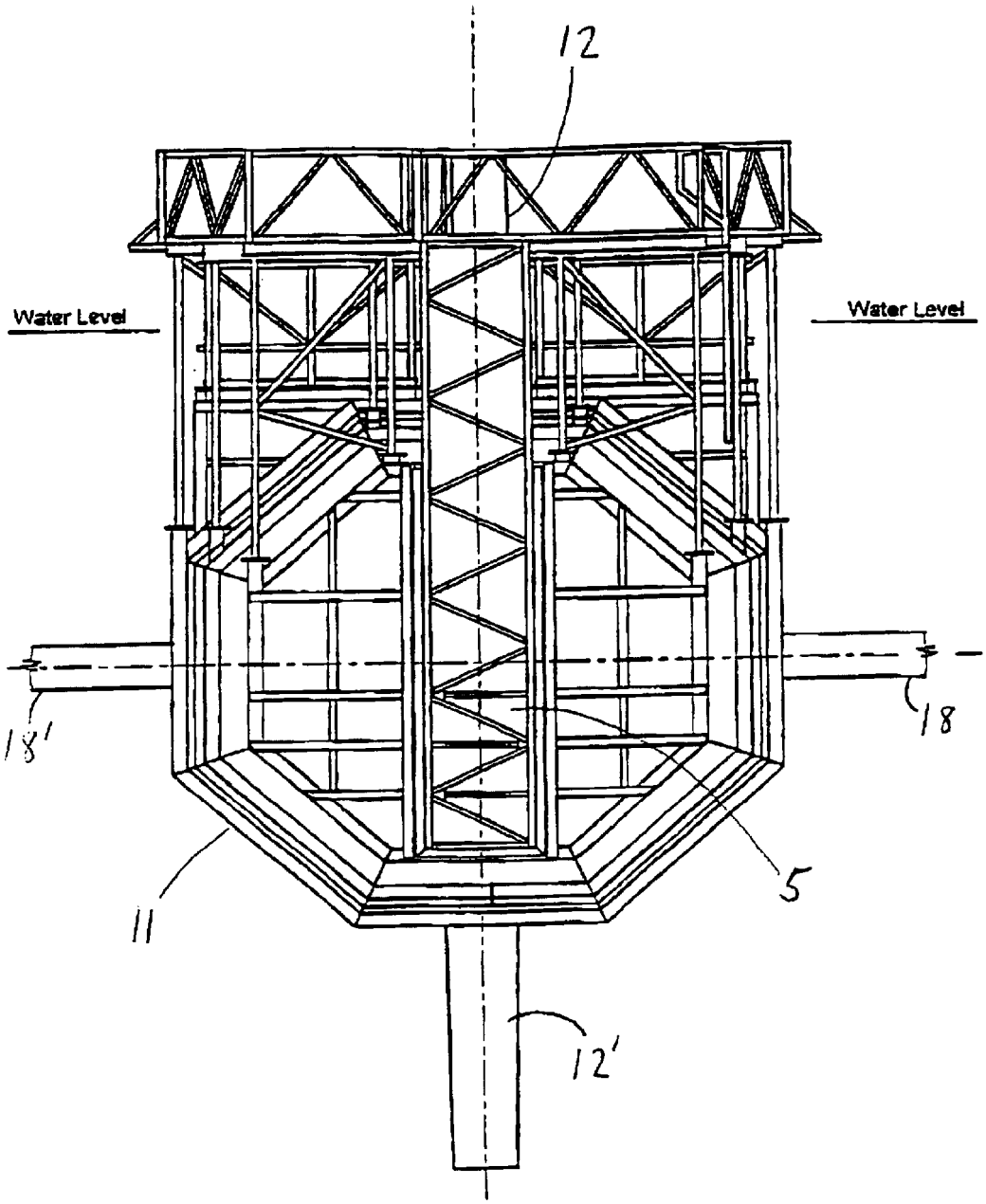
FIG. 4 is an end elevation of the apparatus of FIG. 2 in the direction of arrow A.

As can be seen in FIG. 1, an apparatus according to the invention for enabling work to be carried out on the propulsor unit 1 of a submerged submarine comprises a substantially rigid sleeve like housing 2 which is locatable over the propulsor unit 1 and is sealable against the hull 3 of the submarine to provide a watertight chamber around the propulsor unit 1 from which water can be removed to provide a water free habitat in which work can be carried out on the propulsor unit by maintenance engineers. Access ducts 4, 5 are provided at forward and aft positions on the housing 2, leading upwardly from the interior of the housing to a position above the surface of the water, providing access for users to the housing as well as ventilation for the housing. The housing may comprise a welded metal (such as mild steel) construction, comprising metal sheets welded to a metal framework. To resist corrosion said construction may be coated with a corrosion resistant coating.

In the embodiment shown in FIGS. 2 to 5 the sleeve like housing 2 comprises a forward section 6 which is divided, generally radially, into four equal quadrant segments 7,8,9, 10 which are capable of being bolted together in sealing relationship around the front end of the propulsor unit and a detachable aft section 11, which is bolted to the forward section and in sealing relationship therewith, A pair of adjacent forward access ducts 4,4' are provided on either side of the upper section of the rudder 12 of the submarine extending upwardly from access apertures in the forward section 6 of the housing 2 to an access opening above the surface of the water and a single aft access duct 5 is provided leading upwardly from an access aperture in the rear of the aft section 11 of the housing 2 to an access opening above the surface of the water. The access ducts 4,4',5 have ladders 13 mounted therein and allow workers to climb down into the housing 2 from a walkway 14 mounted above the housing and positioned at a position above the surface of the water. Additionally, a ladder 15 is mounted on outside of the apparatus leading from a side of the walkway 14 allowing divers to climb down into the water to carry out operations on the outside of the apparatus.

Figure 5:
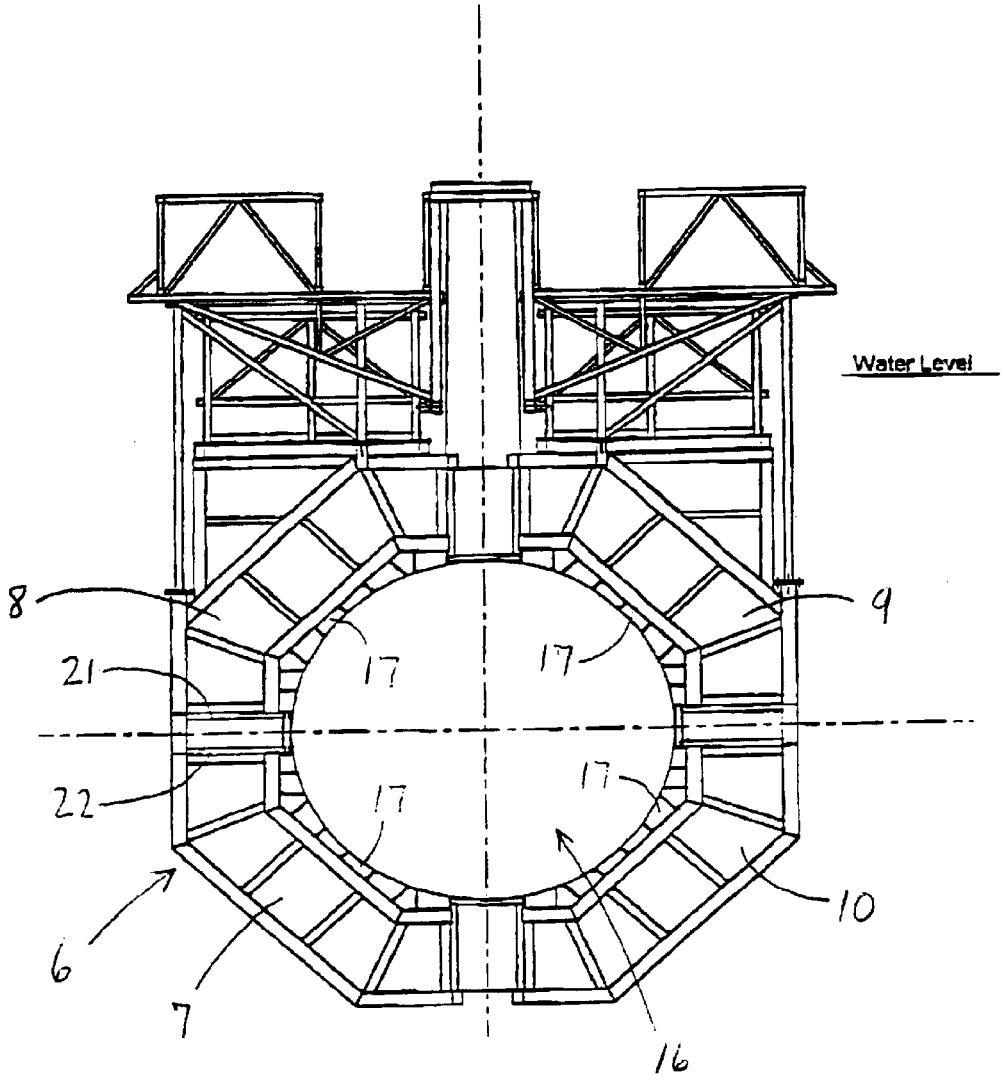
FIG. 5 is an end elevation of the apparatus of FIG. 2 in the direction of arrow B (the submarine being omitted for clarity)

As shown in FIG. 5, the forward section 6 of the housing 2 has an opening 16 therein to enable location over the rear section of the submarine, the inner faces of the opening being lined by rubber sealing sections 17, which sealingly engage the hull 3 of the submarine to form a watertight seal thereagainst.

Figure 6:
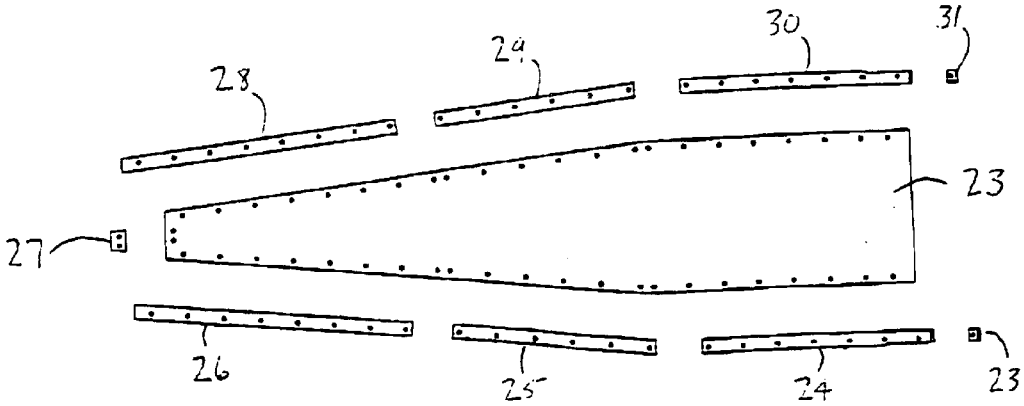
FIG. 6 is a detail plan view of a seal used to seal the gap beneath the hydroplanes and rudder portions of the apparatus of FIG. 2.
Figure 7:
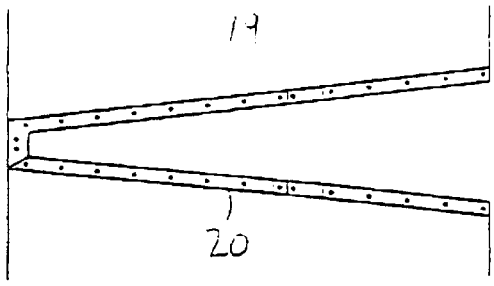
FIG. 7 is a detail side elevation of the portion of the housing to which the seal of FIG. 6 is fitted.
Figure 8:
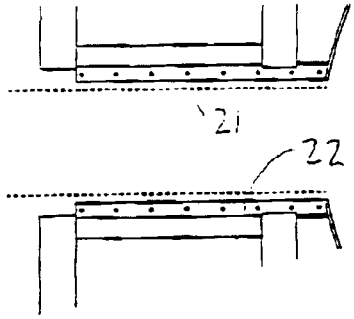
FIG. 8 is a detail end elevation of the portion shown in FIG. 7.
Figure 9:
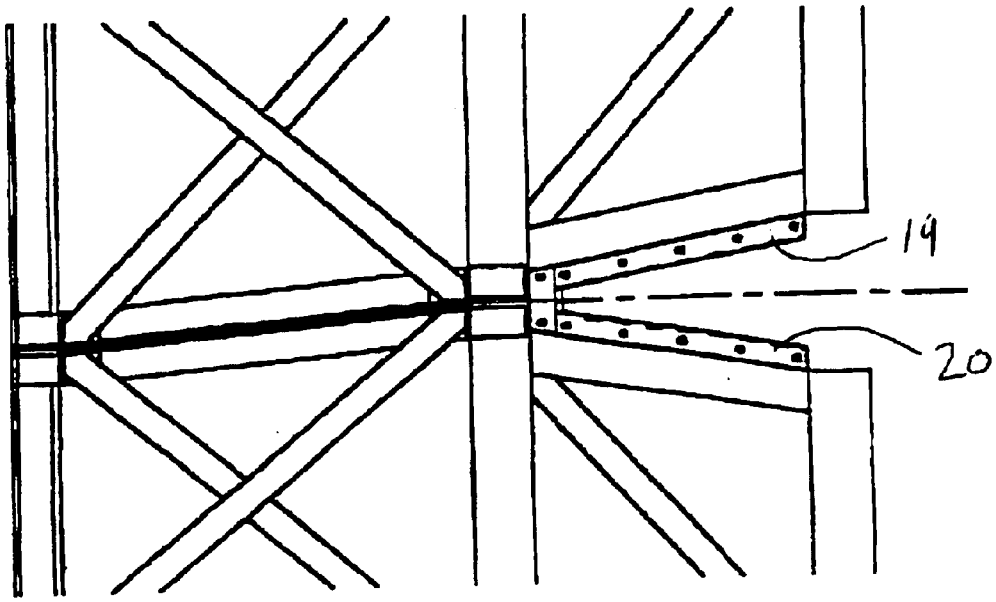
FIG. 9 is a detail side elevation of a portion of the apparatus of FIG. 2 is the region of the hydro planes.
Figure 10:
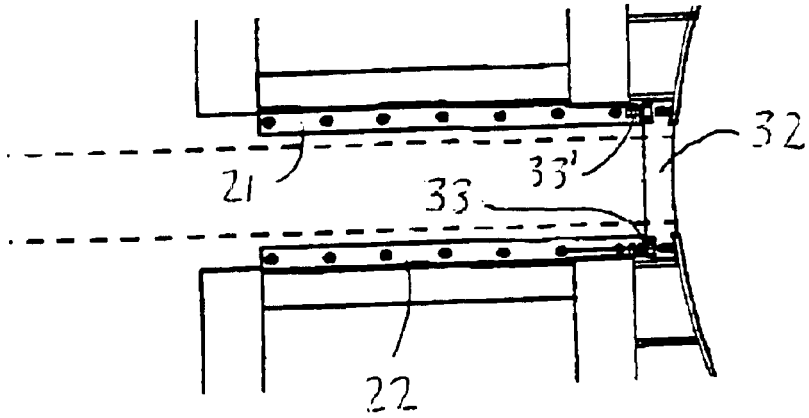
FIG. 10 is a detail end view of the portion of the apparatus shown in FIG. 9.
Figure 11:
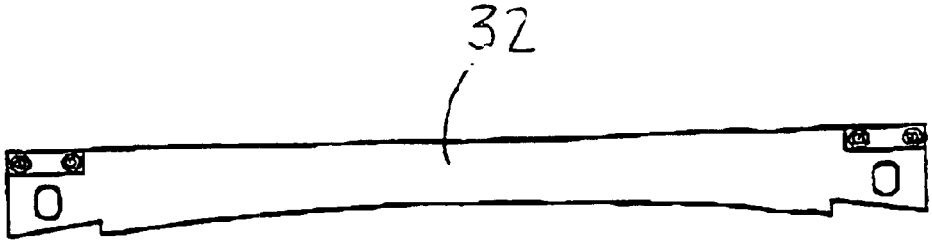
FIG. 11 is a side elevation of a seal clamp plate used with the apparatus of FIG. 2.
Figure 12:
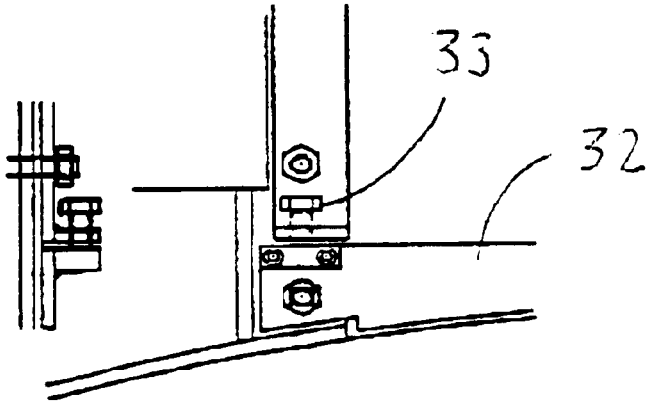
FIG. 12 is a detail view showing the mounting of the clamp plate of FIG. 11. on the apparatus of FIG. 2.

As can be seen from FIGS. 7, 8, 9 and 10, in order to accommodate the upper and lower sections of the rudder 12,12' of the submarine and the port and starboard hydroplanes 18,18', gaps are provided between adjacent sides 19,20,21,22 of the respective quadrant segments 7,8,9,10 of the forward section 6 of the housing 2 on the side (19, 20) and forward (21,22) faces thereof. As shown in FIG. 6, thin flexible rubber seal portions 23 are provided in order to seal said gaps, said seal portions 23 respectively passing through the gaps between the upper and lower rudder sections 12,12' and the port and starboard hydro-planes 18,18' and the propulsor unit, the seal portions being attached to the sides 19,20,21,22 of the quadrant segments 7,8,9,10 of the forward section 6 of the housing 2 by means of clamp plates 23 to 31 bolted to said sides 19,20,21,22. As shown in FIGS. 10, 11 and 12, the forward inner ends of the seal portions 23 are forced against the hull 3 of the submarine in order to provide a seal thereagainst by means of inner clamping plates 32 bridging the gaps between the inner ends of the adjacent sides of adjacent quadrant segments 7,8,9,10. The inner clamping plates 32 are adjustably mounted on adjacent forward faces of the quadrant segments 7,8,9,10 by means of adjusting bolts 33,33'. By tightening the adjusting bolts 33,33' each inner clamping plate 32 can be forced against the hull of the submarine, trapping the respective seal portion 23 between the clamping plate 32 and the hull.

When maintenance of the propulsor unit of a submarine is required, for example in order to repair or replace one or more propulsor blades, firstly the four quadrant segments 7,8,9,10 of the forward section 6 of the housing 2 are assembled around the front section of the propulsor unit such that the rubber sealing sections 17 on the inner faces of the respective front ends thereof sealingly engage the hull of the submarine in front of the propulsor unit. The bolting together of the quadrant segments 7,8,9,10 will normally retainably engage the housing on the hull, although additional securing or retaining means may be provided.

The gaps between the respective quadrant segments 7,8,9,10 adjacent the upper and lower sections of the rudder 12,12' and the port and starboard hydro-planes 18,18' are sealed by fitting the rubber seal portions 23 in said respective gaps. The seal portions 23 are inserted through the respective gaps between the rudder sections 12,12' and hydroplanes 18,18' and the propulsor unit, and the seal portions 23 are secured to sides 19,20,21,22 of the quadrant segments 7,8,9,10 of the forward section 6 of the housing 2 by means of the clamp plates 23 to 31. Finally the forward inner ends of the seal portions 23 are folded to extend along the hull of the submarine and the inner clamping plates 32 are fitted and adjusted to urge said inner ends against the hull of the submarine.

The aft section 11 of the housing 2 is then passed over the rear end of the propulsor unit of the submarine and is secured to the assembled forward section 6, completing the housing 2. The two sections 6,11 are secured together by bolts passing through respective flanges forming opposed mating surfaces on the two sections. Resilient sealing means may be provided between the sections.

Next the two forward 4,4' and single aft 5 access ducts are secured to the housing 2 and the remaining framework 34 is attached to the housing 2, including the walkway 14. Once the apparatus has been assembled, the water can be pumped out of the housing 2 (and access ducts 4,4',5), providing a water free working space around the propulsor unit in which maintenance activities can be undertaken.

In order to avoid or restrict any upward force on the rear section of the submarine resulting from the buoyancy of the housing 2 when the water is removed therefrom, ballast weights (100, FIG. 3) can be added to supporting areas of the framework of the apparatus so that, in use, the apparatus has neutral buoyancy, with no or minimal resultant force acting on the submarine.

A pump (not shown) is provided in a sump provided at the lowermost point of the housing in order to remove any water that might enter the housing via any leaks between the various sections or the seal against the hull of the submarine.

Although any resultant force acting on the submarine due to the apparatus, either due to the weight of the apparatus or the buoyancy of the housing 2 when water is removed therefrom, is minimized by the use of carefully calculated ballast weights, a cradle (not shown) may be provided in the aft section 11 of the housing, lightly engaging the hull of the submarine in order to avoid any movement of the housing 2 relative to the submarine as a result of any resultant force or due to other forces, such as currents in the water, thus preventing any failure of the seal 17 between the housing 2 and the hull of the submarine which might result from such movement.

When welding operations are to be carried out within the housing 2, fan means may might be provided adjacent at least one of the access ducts 4,4',5 in order to create a through flow of air through the housing, thus removing any noxious gases from the housing 2 which might otherwise harm the persons working therein.

What is claimed is:

1. An apparatus for providing an air space around a submerged portion of a floating submarine comprising a generally cylindrical or sleeve-like or tubular housing locatable around a substantially cylindrical or tubular region of a hull of the submarine such that said housing extends completely around the exterior of said portion of the hull contained within said housing, said housing having an opening at at least one end which is locatable to be in sealing engagement with an outer surface of part of the hull of the submarine with said housing forming a water evacuable space around said region of the hull and any part or apparatus to be worked upon wherein a forward section of the housing has an opening therein to enable location over a rear section of the submarine, and an access passage or duct for work personnel in communication with said space and extending upwardly from said housing such as to be, in use, above the surface of the water in which the submarine is floating.

2. The apparatus of claim 1, wherein a horizontal cross-sectional area of the at least one access duct is substantially less than a horizontal cross sectional area of the housing.

3. The apparatus of claim 1, wherein inner faces of the opening are lined by resilient sealing means which sealingly engage the hull of the submarine to form a watertight seal thereagainst.

4. The apparatus of claim 1, wherein additional weights or ballast are attached to or mounted on the apparatus to counteract a lift effect when water is removed from the housing.

5. The apparatus of claim 1, wherein at least one access duct is provided adjacent each end of the housing, providing a through flow of air for ventilating the housing.

6. The apparatus of claim 1, wherein the housing is formed in sections separable/connectable along transverse or upwardly extending planes.

7. The apparatus of claim 6, wherein at least one section of the housing is formed from interconnectable segments, separable/connectable along generally radial planes.

8. The apparatus of claim 7, wherein said at least one section comprises the section which, in use, is closest to a bow of the submarine, said section being formed from four interconnectable segments.

9. The apparatus of claim 7, wherein the radially separable segments of said at least one section of the housing extend, in use, in the region where a rudder and the hydroplanes sections proximate the hull of the submarine and, to facilitate fitting and/or provide safety clearance and to provide fitting or assembly tolerances for accommodating for any difficulties in bolting the radially seperable segments together, the radially separable segments of said one section of the housing have spaced/non-abutting portions forming gaps which each provide a free space adjacent the base of a upper and lower portions of the rudder and the hydroplane sections of the submarine.

10. The apparatus of claim 9, wherein said gaps are closed by thin resilient sealing means secured to extend across the gaps.

11. The apparatus of claim 6, wherein the sections and/or segments are bolted together in sealing relationship.

12. The apparatus of claim 6, wherein sealing means are provided between the separating surfaces of the sections and/or segments.

13. The apparatus of claim 1, wherein the sleeve like housing comprises a welded metal construction.

14. The apparatus of claim 1, wherein at least a portion of the sleeve-like housing is formed from a flexible material.

15. The apparatus of claim 14, wherein the flexible material forms a substantially annular central section of the housing sealingly interconnecting rigid forward and aft sections, or alternatively, the entire aft section of the housing is constructed from a flexible material sealingly connected to a rigid forward section.

16. The apparatus of claim 14, wherein the entire sleeve-like housing is formed from a flexible material.

17. The apparatus of claim 1, wherein a framework forming a walkway is mounted on the housing and leads to said access duct and also provides ballast supporting platforms.

18. A method of carrying out work on a submerged portion of a floating submarine comprises locating a generally cylindrical or sleeve-like housing around a substantially cylindrical or tubular region of a hull of the submarine such that said housing extends completely around the exterior of said portion of the hull contained within said housing, said housing having at least one access duct extending upwardly from the housing to a position above the surface of the water wherein a forward section of the housing has an opening therein to enable location over a rear section of the submarine, sealing one end of the housing against said region of the submarine, removing water from said housing to provide a gaseous and substantially water-free habitat in the region of said portion, and subsequently carrying out said work on said portion in the gaseous habitat, access to the housing being provided by means of the at least one access duct.

19. The method of claim 18, wherein the method also includes the step of providing ballast on the housing to counterbalance the buoyancy of the housing when the water is removed from said housing so that the housing has neutral buoyancy.

* * * * *